US008933978B1

(12) United States Patent
Fowell et al.

(10) Patent No.: US 8,933,978 B1
(45) Date of Patent: Jan. 13, 2015

(54) PRINTING DEVICE HAVING REUSABLE CARD

(71) Applicant: Assa Abloy AB, Stockholm (SE)

(72) Inventors: Daniel J. Fowell, Chaska, MN (US); Jeffrey L. Stangler, Eden Prairie, MN (US)

(73) Assignee: Assa Abloy AB, Stockholm (SE)

( * ) Notice: Subject to any disclaimer, the term of this patent is extended or adjusted under 35 U.S.C. 154(b) by 0 days.

(21) Appl. No.: 14/297,845

(22) Filed: Jun. 6, 2014

(30) Foreign Application Priority Data

Jul. 22, 2013 (CH) ..... 1295/13

(51) Int. Cl.
*B41J 2/325* (2006.01)
*B41J 2/32* (2006.01)
*B41J 13/00* (2006.01)

(52) U.S. Cl.
CPC ..... *B41J 13/0009* (2013.01)
USPC ..... 347/179; 347/215; 347/220; 347/217; 347/171

(58) Field of Classification Search
USPC ..... 347/171, 179, 215, 217, 220
See application file for complete search history.

(56) References Cited

U.S. PATENT DOCUMENTS 4,531,135 A 7/1985 Toshima
5,001,749 A * 3/1991 Iggulden et al. ..... 358/296
5,634,731 A 6/1997 Kita et al.
5,949,467 A 9/1999 Gunther et al.
6,106,910 A 8/2000 Tan et al.
6,773,772 B2 8/2004 Shinozaki et al.
7,878,505 B2 2/2011 Meier et al.
8,080,358 B2 12/2011 Murakami
8,382,092 B2 2/2013 Meier et al.
2012/0306986 A1 * 12/2012 Bouverie et al. ..... 347/215

FOREIGN PATENT DOCUMENTS

EP 0730974 A2 9/1996
EP 1884368 A1 2/2008
EP 2018275 B1 2/2012
JP 60147372 8/1985
JP 61061877 3/1986
JP 63254092 10/1988

(Continued)

OTHER PUBLICATIONS

Search Report from corresponding Swiss Patent Application No. CH01295/13, filed Jul. 22, 2013.

(Continued)

*Primary Examiner* — Sarah Al Hashimi
(74) *Attorney, Agent, or Firm* — Westman, Champlin & Koehler, P.A.

(57) ABSTRACT

Embodiments of the invention are directed to a substrate processing device, such as a printing device. In some embodiments, the device includes a substrate supply, a reusable card, an operative unit, at least one transport mechanism, and a controller. The substrate supply is configured to support a plurality of operative substrates. The reusable card is stored in a dedicated storage area, which does not receive the operative substrates. The controller is configured to control the at least one transport mechanism and the operative unit to deliver the reusable card from the storage area to the operative unit, to process the reusable card with the operative unit, and return the reusable card to the storage area, multiple times.

16 Claims, 11 Drawing Sheets

(56) References Cited

FOREIGN PATENT DOCUMENTS

| | | | |
|---|---|---|---|
| JP | 10086424 | | 4/1998 |
| WO | 2007135403 | A1 | 11/2007 |
| WO | 2013137880 | A1 | 9/2013 |

OTHER PUBLICATIONS

International Search Report and Written Opinion of PCT/US2012/029164, mailed Jan. 31, 2013.

* cited by examiner

PRINTING DEVICE HAVING REUSABLE CARD

CROSS-REFERENCE TO RELATED APPLICATION

This Application claims priority to and the benefit of Swiss Patent Application No. CH 01295/13, filed with the Swiss Intellectual Property Office on Jul. 22, 2013, the disclosure of which is incorporated herein by reference in its entirety.

BACKGROUND

Credentials include identification cards, driver's licenses, passports, and other documents. Credential manufacturing devices process substrates, such as plastic card substrates using one or more processing devices form credential products. Common processes performed by such devices on substrates include, for example, printing processes, laminating processes, and data reading and writing processes.

Printing processes performed by credential manufacturing devices generally operate to print information, such as a photo, account numbers, identification numbers, and other personal information to the substrate. Such printing processes may use a thermal print head and a print ribbon. The print ribbon generally includes a series of colored dye panels (e.g., yellow, cyan and magenta) and a black resin or fusible pigment panel (hereinafter "black resin panel"). The print head includes a line of resistive heating elements, each of which is selectively activated to heat a corresponding portion of one of the panels of the print ribbon and transfer a pixel of print material (i.e., dye or resin) from the panel to the desired surface, such as the surface of the substrate. A wide range of colored pixels may be formed by overlaying pixels of the various colored dyes.

An image is printed to a surface of the substrate by aligning one of the panels of the print ribbon with the substrate, advancing the panel and the substrate past the print head, and heating portions of the panels to transfer pixels of print material to the surface using the print head. These steps may be repeated for other panels of the print ribbon to complete the printing of the desired image on the substrate.

When an image is printed using the black resin panel, a negative of the image remains on the black resin panel due to the removal of the black resin. Such residual images may contain confidential information. As a result, it is desirable to obscure or erase residual images in the black resin panels to eliminate the risk of such information being accessed after the used print ribbon is discarded.

SUMMARY

Embodiments of the invention are directed to a substrate processing device, such as a printing device. In some embodiments, the device includes a substrate supply, a reusable card, an operative unit, at least one transport mechanism, and a controller. The substrate supply is configured to support a plurality of operative substrates. The reusable card is stored in a dedicated storage area, which does not receive the operative substrates. The controller is configured to control the at least one transport mechanism and the operative unit to deliver the reusable card from the storage area to the operative unit, to process the reusable card with the operative unit, and return the reusable card to the storage area, multiple times.

Some embodiments of the invention are directed to a method of obscuring used portions of a print ribbon using the device. In some embodiments, a portion of the print ribbon is used to print an image on an operative or print substrate, which results in the formation of a residual image on the portion of the print ribbon. The operative substrate is then fed using the at least one transport mechanism. The reusable or erase card is fed from the storage area using the at least one transport mechanism. The residual image is obscured by printing an image to the reusable card using the print head and the portion of the print ribbon comprising the residual image. The reusable card is then returned to the storage area using the at least one transport mechanism.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
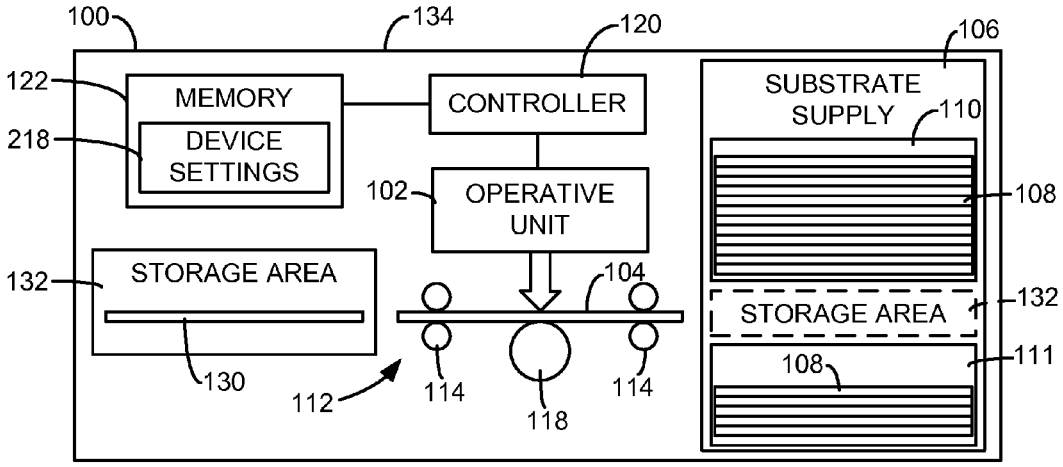
FIG. 1 is a simplified diagram of a printing device formed in accordance with embodiments of the invention.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the scope of the invention as set forth in the appended claims.

Sufficient details are given in the following description to provide those of ordinary skill in the art with a thorough understanding of the embodiments. Well-known and understood components, circuits, processes and techniques may be illustrated in block diagram form or not shown in the drawings in order to avoid obscuring disclosed embodiments in unnecessary detail.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in a figure or described herein. Further, it is understood that embodiments of disclosed process steps include the performance of the process step through the execution of program instructions stored in a tangible medium by one or more processors.

FIG. 1 is a simplified diagram of a printing device 100, such as a credential manufacturing device, formed in accordance with embodiments of the invention. In some embodiments, the device 100 includes one or more processing or operative units 102, each of which are configured to perform a process on a substrate used in the device, generally referred to as 104. Exemplary embodiments of the operative units 102 include a print unit configured to print an image to a surface of the substrate 104, a laminating unit configured to apply an overlaminate material to the substrate 104, a data writer configured to write or encode data to the substrate 104, a data reader configured to read data stored on the substrate 104, a substrate rotator configured to rotate the substrate 104, and/or other conventional substrate processing device.

In some embodiments, the device 100 includes a substrate hopper 106 configured to contain or support a plurality of operative substrates 108, such as credential substrates including card substrates used to form identification cards and other credentials, for example. In some embodiments, the hopper 106 includes multiple bins or containers for supporting the operative substrates 108, such as bins 110 and 111. In some embodiments, some of the bins of the hopper 106, such as bin 110, are configured to discharge substrates 108 for processing by the one or more operative units 102 of the device 100, while other bins of the hopper 104, such as bin 111, are configured to collect substrates 108 after processing by the one or more operative units 102.

In some embodiments, the device 100 includes at least one transport mechanism that is configured to feed individual substrates 104 from the hopper 106 to the one or more operative units 102 for processing. Embodiments of the transport mechanism 112 include motorized feed rollers 114 or pinch rollers, motorized platen rollers 118, conveyer belts, and/or other conventional mechanisms used to transport substrates 104.

In some embodiments, the device 100 includes a controller 120 that is configured to control the components of the device 100 and carry out method steps described herein. In some embodiments, the controller 120 represents one or more processors that are configured to execute instructions stored in memory 122, or other location, to perform the method steps. In some embodiments, the controller 120 controls the feeding of individual substrates 104 through the control of the motors of the at least one transport mechanism 112 that drives the feed rollers 114 or other components. In some embodiments, the controller 120 controls the operation of the one or more operative units 102 to perform the desired process on the substrates, such as a printing process, a laminating process, and/or a data encoding process, for example. The controller 120 may also operate in accordance with controllers of conventional printing devices and credential manufacturing devices, and perform other functions and method steps described herein.

In some embodiments, the device 100 utilizes one or more reusable cards 130 to perform a process within the device 100. In some embodiments, the one or more reusable cards 130 are configured to be stored within a dedicated storage area 132. In some embodiments, the term "dedicated storage area," means a storage area that receives or supports the one or more reusable cards 130, but does not receive or support the operative substrates 106.

In some embodiments, the storage area 132 is contained within a housing 134 of the device 100, as illustrated in FIG. 1. In some embodiments, the storage area 132 is accessible by users of the device 100. In other embodiments, the storage area is not readily accessible by the users of the device 100.

In some embodiments, the dedicated storage area 132 may be contained within the substrate hopper 106, as indicated in phantom lines in FIG. 1. In some embodiments, the storage area 132 may be located below an upper bin 110 of the hopper 106 configured to contain the operative substrates 108, between the upper bin 110 and the lower bin 111 of the hopper 106, or in another location of the hopper 106.

The reusable card or cards 130 may take on various forms. In some embodiments, the reusable card 130 is in a similar form as the operative substrates 108. In some embodiments, the reusable card 130 is different from the operative substrates 108. For instance, in some embodiments, the operative substrates 108 are rigid or semi-rigid plastic card substrates, which are used, for example, to form identification cards, and generally require the operative substrate 108 to be fed along a substantially flat processing path by the transport mechanism 112. In some embodiments, the reusable card 130 is significantly more flexible than the operative substrates 108. Accordingly, in some embodiments, the transport mechanism 112 may significantly flex the reusable substrate 130 to maneuver it to a desired location, such as around rollers or other components. This allows greater flexibility to the location of the storage area 132 than is possible when using conventional operative substrates 108.

Figure 2:
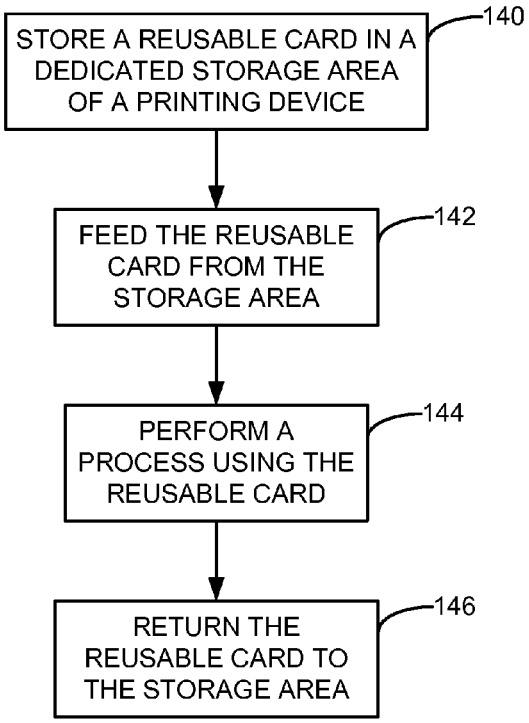
FIG. 2 is a flowchart illustrating a method of operating the device in accordance with embodiments of the invention.

FIG. 2 is a flowchart illustrating a method of operating the device 100 in accordance with embodiments of the invention. At 140, a reusable card 130 is stored in a dedicated storage area 132 of a printing device 100. The reusable card 130, the storage area 132 and the printing device 100 of step 140 are formed in accordance with one or more embodiments described above.

At 142 of the method, the reusable card 130 is fed from the storage area 132 using the at least one transport mechanism 112. In some embodiments, the transport mechanism 112 utilizes motorized feed rollers or other conventional components to feed the reusable card 130 from the storage area 132.

At 144, a process is performed using the reusable card 130. Embodiments of the process that is performed using the reusable card 130 include, for example, a printing process in which print material is transferred from a print ribbon to a surface of the reusable substrate, a data reading or writing process in which data is read from, or written to the reusable card 130, a cleaning process in which a component or components of the device are cleaned using the reusable card 130, a calibration process in which one or more components of the device 100 are calibrated using the reusable card 130, and or other process using the reusable card 130. In some embodiments, the reusable card 130 is returned to the storage area 132 using the at least one transport mechanism 112 at step 146. In some embodiments, the reusable card 130 may be discharged from the device following the processing step 144.

Figure 3:
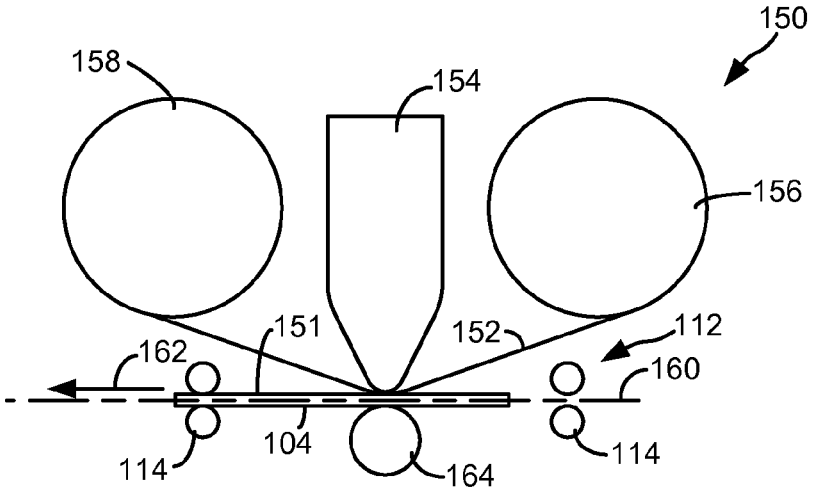
FIGS. 3 and 4 are simplified side views of exemplary print units formed in accordance with embodiments of the invention.
Figure 4:
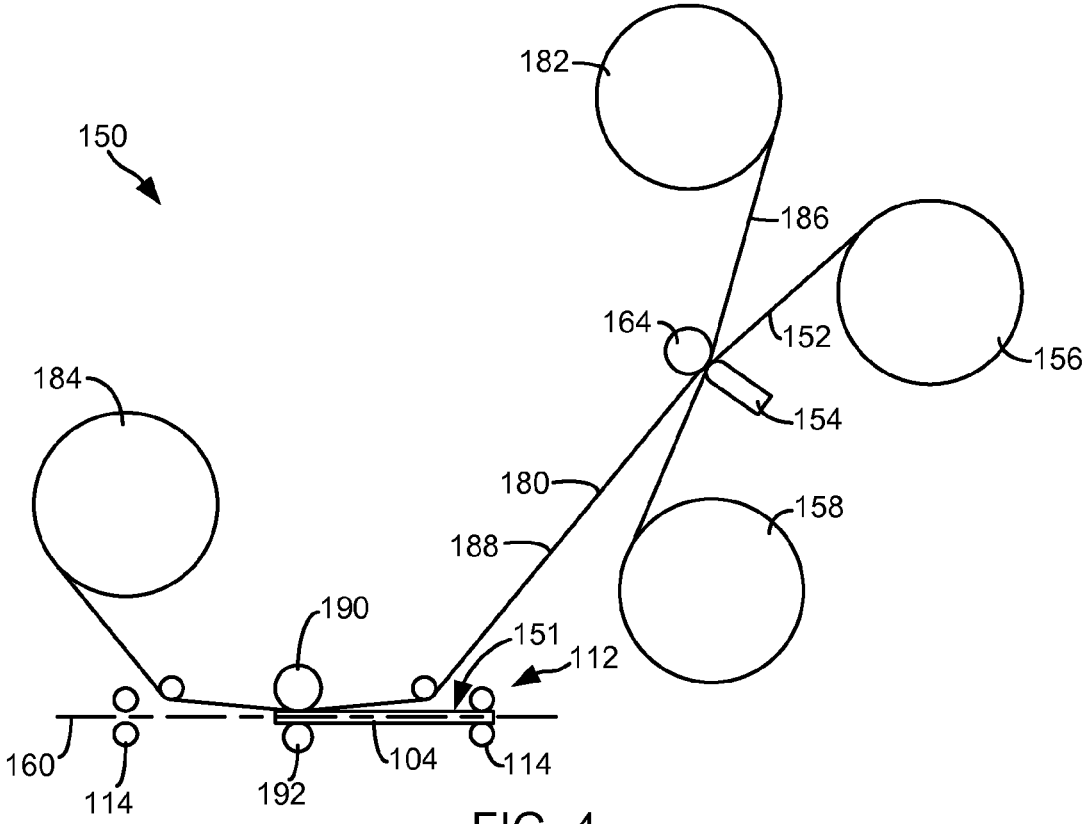

In some embodiments, the device 100 includes an operative unit 102 in the form of a print unit and step 144 involves a printing process using the print unit and the reusable card 130. FIGS. 3 and 4 are simplified side views of exemplary print units 150 formed in accordance with embodiments of the invention. In some embodiments, the print unit 150 includes a print ribbon 152 and a print head 154. In some embodiments, the print head 154 is a conventional thermal print head that includes a line of heating elements, which are selectively activated to transfer pixels of print material from the print ribbon 152. The print units 150 are configured to print an image (i.e., transfer print material) from the print ribbon 152 to a surface 151 of a substrate 104, such as one of the operative substrates 108 (i.e., print substrate), or one of the reusable cards 130, using the print head 154.

Figure 5:
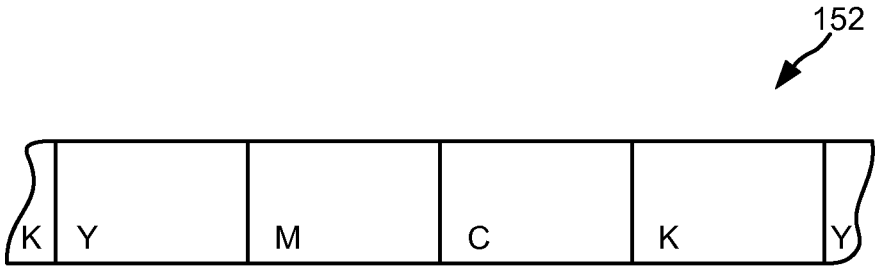
FIG. 5 is a simplified top plan view of an exemplary print ribbon in accordance with embodiments of the invention.

In some embodiments, the print ribbon 152 is supported between a supply roll 156 and a take-up roll 158. FIG. 5 is a simplified top plan view of an exemplary print ribbon 152 in accordance with embodiments of the invention. In some embodiments, the print ribbon 152 includes a black resin or fusible pigment print panel (K) formed in accordance with conventional resin print panels. In some embodiments, the print ribbon 152 includes colored dye panels such as, for example, a yellow dye panel (Y), a magenta dye panel (M), and a cyan dye panel (C). In some embodiments, the panels extend in a repeatable series.

The exemplary print unit 150 of FIG. 3 is generally configured to directly print images to the surface 151 of the substrate 104. In some embodiments, the print unit 150 may include a conventional print head lift mechanism that is configured to move the print head 154 relative to a processing path 160, along which the substrates 104 are fed in a feed direction 162 using the at least one transport mechanism 112. In some embodiments, the print unit 150 includes a print platen or roller 164, or other suitable component that supports the substrate 104 and allows the print ribbon 152 to be pressed against the surface 151 of the substrate 104 during a printing operation.

Figure 6:
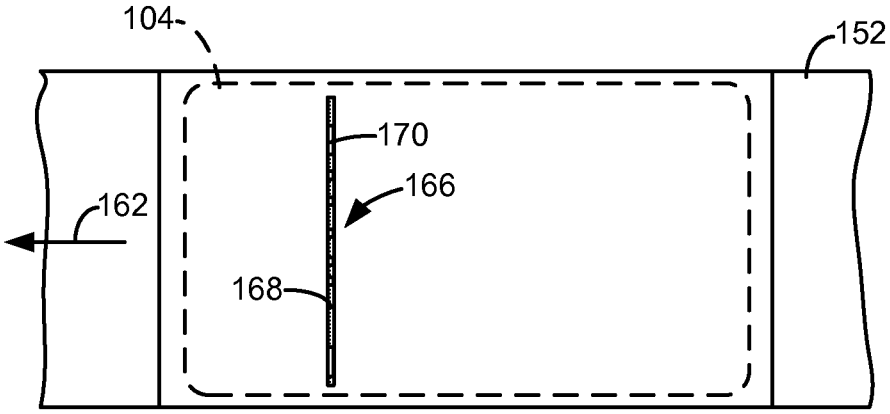
FIG. 6 is a simplified top view illustrating a transfer of pixels of print material from a print ribbon to a surface of a substrate during a printing operation using the print unit of FIG. 3.

FIG. 6 is a simplified top plan view illustrating the transference of pixels of print material from the print ribbon 152 to the surface 151 of a substrate 104 during a printing operation using the print unit 150 of FIG. 3. Initially, one of the panels of the print ribbon 152 is aligned with the substrate 104, such as through the winding of the print ribbon 152 on to the take-up roll 158 under the control of the controller 120, in accordance with conventional techniques. The resistive heating elements of the print head 154, which extend in a longitudinal line across the width of the substrate 104, are selectively activated to transfer a pixel line 166 from the print panel to the substrate 104. The pixel line 166 comprises pixels 168 of print material corresponding to the activated heating elements and portions 170 corresponding to deactivated heating elements that do not contain print material. As the substrate 104 and the print ribbon are fed together in the feed direction 162 past the print head 154, the print head 154 prints additional pixel lines 166 to the substrate 104 using the aligned panel of the print ribbon 152. Additional color layers of pixels may be printed to the surface 151 by, for example, displacing the print head 154 from the processing path 160, aligning another color panel of the print ribbon 152 with the substrate 104, and feeding the print ribbon 152 and the substrate 104 along the processing path 160 relative to the print head 154, as the print head 154 selectively transfers pixels lines 166 from the print panel to the substrate 104. This may be repeated until the desired image is formed on the surface 151 of the substrate 104.

The print unit of FIG. 4 is generally configured to perform a reverse-image printing process to print an image to the surface 151 of the substrate 104, in accordance with conventional techniques. As with the print unit 150 of FIG. 3, the print unit 150 in FIG. 4 includes the print ribbon 152, the print head 154, and the print platen or roller 164. However, rather than printing the image directly to the substrate 104, the image is printed to a transfer ribbon 180, from which the image is transferred to the surface 151 of the substrate 104 through a transfer lamination process.

In some embodiments, the transfer ribbon 180 is supported between a supply roll 182 and a take-up roll 184. In some embodiments, the transfer ribbon 180 includes a transfer film 186 that is supported on a carrier or backing material 188 and faces the print ribbon 152. The print head 154 and the print ribbon 152 are used to print an image to the transfer film 186, in generally the same manner as described above with reference to FIG. 6. The image on the transfer film 186 is then aligned with the surface 151 of the substrate 104, and the image and the substrate 104 are fed past a laminating roller 190. The laminating roller 190 presses the transfer film 186 against the surface 151 under the support of a roller 192, and heats the transfer film 186 to bond the imaged transfer film 186 to the surface 151. The backing material 188 is then peeled from the portion of the transfer film that is bonded to the substrate 104 leaving the imaged portion of the transfer film 186 attached to the substrate 104 and completing the reverse-image printing process.

Figure 7:
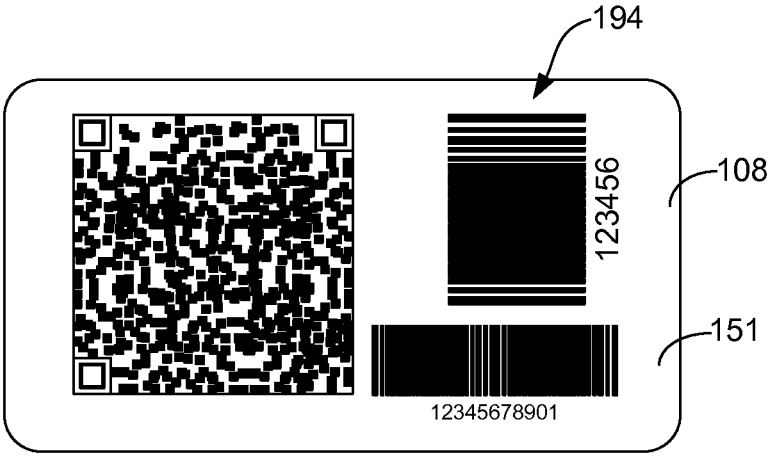
FIGS. 7 and 8 respectively are a top view of a surface of a substrate with a printed image, and a top view of a resin print panel a print ribbon used to form the printed image.
Figure 8:
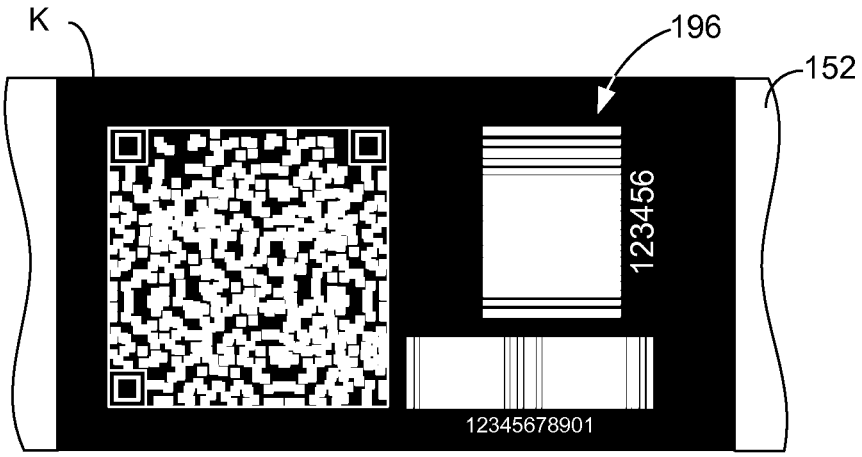

Occasionally, the printing of images to the operative substrates 108 using the print unit 150 results in the formation of a residual image on the portions of the print ribbon 152 used to print the images. While the delivery of dye from the colored dye panels (Y, M, C) of the print ribbon 152 do not generally leave behind a traceable record of the printed image on the dye panels of the print ribbon 152, the transference of the resin from the black panel K leaves behind a record of the printed image. This is illustrated in FIGS. 7 and 8, which respectively show a top plan view of a substrate 108 with an image 194 printed on the surface 151, and a top plan view of a resin print panel K of the print ribbon 152 used to form the image 194. In some embodiments, the image 194 was formed using the print head 154 as discussed above with reference to FIGS. 3 and 4, by transferring resin pixel lines 166 comprising resin pixels 168 from the print panel K either directly to the surface 151 using the print head 154, or to the transfer film 186. The transference of the resin pixels from the panel K produces a residual image 196 on the print panel K that is a negative of the image 194, as shown in FIG. 8. As a result, the information printed in the image 194 may be obtained through a review of the residual image 196 on the print panel K of the print ribbon 152. This creates a potential security risk when the image 194 contains sensitive or confidential information.

In some embodiments of step 144 of the method, one or more images are printed to the reusable card 130 using the print unit 150 (i.e., operative unit 102) to erase or obscure one or more of such residual images 196 on the print ribbon 152. In general, the controller 120 is configured to process the reusable or erase card 130 using the print unit 150 to obscure the residual image or images 196 by printing an image to the card 130 using the print head 154 and the portion of the print ribbon 152 comprising the residual image 196.

Figure 9:
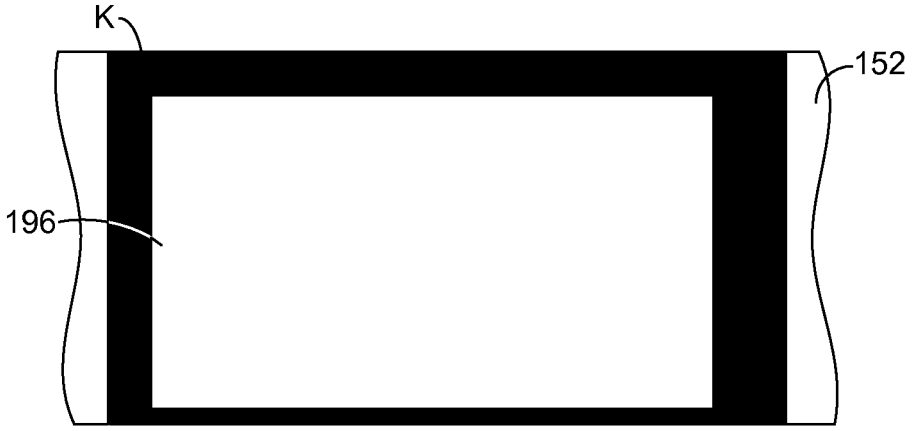
FIGS. 9 and 10 are top views of the resin print panel of FIG. 8 following the printing of an erasing or obscuring image in accordance with embodiments of the invention.

In some embodiments, the image printed to the card 130 results in the removal of the residual image 196 from the print ribbon 152. This is illustrated in FIG. 9, which is a top plan view of the resin print panel K of FIG. 8 following the printing of the image to the card 130 in step 144. In some embodiments, this involves activating substantially all of the heating elements of the print head 154 to transfer all of the pixels in the pixel line 166 (FIG. 6) to the card 130. Thus, the entire residual image 194 may be erased from the print ribbon 152 using this technique in step 144 of the method.

Figure 10:
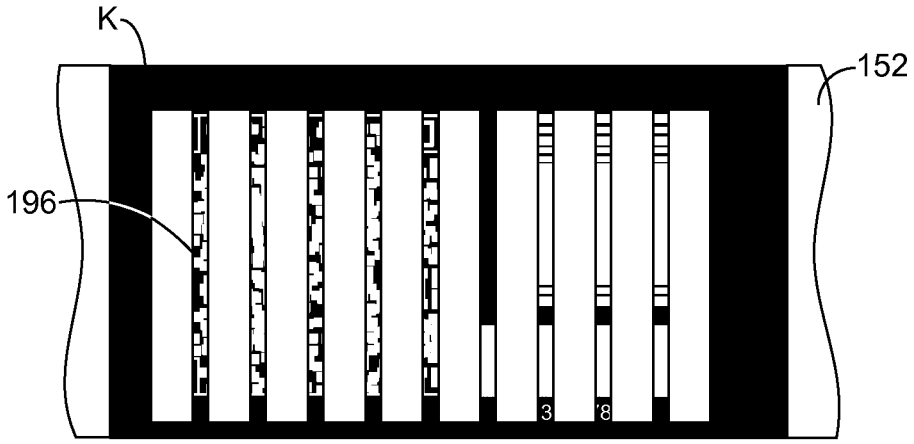

Alternatively, an image may be printed to the card 130 using the portion of the print ribbon 152 that includes the residual image 196 that effectively obscures the residual image 196. In some embodiments, a series of lines or bars are printed to the card 130 using the portion of the print ribbon 152 that includes the residual image 196. The printed lines or bars obscure the residual image 196 on the print ribbon 152, as shown in FIG. 10, which is a top plan view of the panel of FIG. 8 following the printing of the image to the card 130 in step 144. Other images or patterns may be printed to the card 130 to ensure proper obscurement of the residual image 196 on the print ribbon 152.

Figure 11:
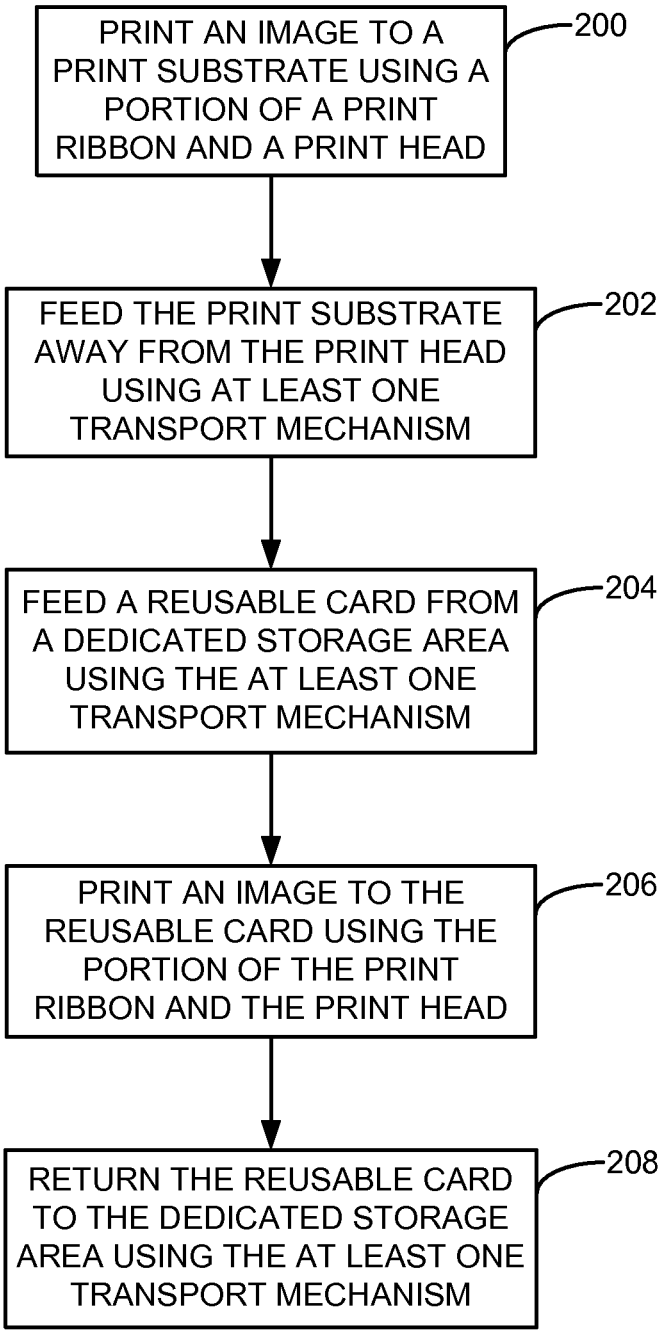
FIG. 11 is a flowchart illustrating a method of erasing or obscuring a residual image on a print ribbon using a reusable card, in accordance with embodiments of the invention.

FIG. 11 is a flowchart illustrating a method of erasing or obscuring a residual image on a print ribbon using the card 130, in accordance with embodiments of the invention. At 200, an image 194 (FIG. 7) is printed to a substrate 108 using a portion of a print ribbon 152 and a print head 154. This results in the formation of a residual image on the portion of the print ribbon 152 used to form the image 194, as shown in FIG. 8. At 202, the printed substrate 108 is fed using the at least one transport mechanism 112 (FIG. 1). At 204, a reusable or erase card 130 is fed from a dedicated storage area 132 (FIG. 1) using the at least one transport mechanism 112. At 206, an image is printed to the card 130 using the portion of the print ribbon 152 containing the residual image 196 and the print head 154. This results in the erasure or obscurement of the residual image 196, such as shown in FIGS. 9 and 10. At 208, the card 130 is returned to the dedicated storage area 132 using the at least one transport mechanism 112. In some embodiments, this method is repeated each time an image is printed to one of the operative substrates 108.

In some embodiments, the residual image erasing or obscuring process (i.e., FIGS. 2 and 11) performed using the card 130 is not performed each time an image is printed to one of the operative substrates 108. Rather, the method is performed after images are printed to two or more of the substrates 108. Thus, in some embodiments, step 144 of the method of FIG. 2 and step 206 of the method of FIG. 11 involve the printing of multiple images to the erase or reusable card 130 using the different portions of the print ribbon 152 used to print images to the substrates 108, to complete the erasure or obscurement of the residual images on the portions of the print ribbon 152. In some embodiments, the card 130 is returned to the storage area 132 following the printing of the multiple images to the card 130.

In some embodiments, the controller 120 is configured to keep track of the residual images on the print ribbon 152 as the substrates 108 are processed by the device 100. The controller 120 then controls the performance of step 144 or 206 to erase or obscure the residual images using the card 130 as discussed above. In some embodiments, the controller 120 keeps track of the residual images on the print ribbon 152 by storing the necessary information in the memory 122 (FIG. 1) or other location. During the residual image erasing or obscuring step, the controller 120 accesses the memory 122 to identify the locations along the print ribbon 152 requiring erasure or obscurement using the card 130. The controller 120 then controls the device 100 to perform the residual image erasing and obscuring process using the card 130 to erase or obscure the residual images on the print ribbon 152.

In some embodiments, the device 100 is configured to process print jobs, in which multiple substrates 108 are processed by the device including the printing of images to the substrates 108. In some embodiments, the residual image erasing or obscuring process is performed to erase or obscure existing residual images on the print ribbon 152 using the card 130 either before the device 100 processes the next print job, or immediately after the device 100 processes a print job.

In some embodiments, the device 100 is configured to process print sessions, in which several print jobs are processed by the device 100. In some embodiments, the residual image erasing or obscuring process is performed using the card 130 either before the start of a new print session, or immediately after the processing of a print session.

In some embodiments, the residual image erasing or obscuring process is performed using the card 130 when the end of the print ribbon 152 has been reached, or when a print ribbon change is requested. In some embodiments, the residual image erasing or obscuring processes are performed using the card 130 during a startup routine of the device 100, or following a reboot or shut down of the device 100. In some embodiments, the residual image erasing or obscuring method is performed using the card 130 in response to a request of a user of the device 100, or an external controller.

In some embodiments, the one or more operative units 102 include a conventional substrate rotator configured to rotate the reusable card 130 and/or the substrates 108. In some embodiments, the controller 120 uses the substrate rotator to rotate the card 130 to allow both sides of the card 130 to be used in the residual image erasing or obscuring processes described above.

In some embodiments, it is desirable to limit the number of times the reusable card 130 may be used to erase or obscure residual images on the print ribbon 152. In some embodiments, the controller 120 maintains a count of the number of residual images that have been erased or obscured using the card 130, or other measure. In some embodiments, the controller 120 provides a notification to the user of the device when the count reaches a threshold number. In some embodiments, the card 130 is inverted using the substrate rotator operative unit 102 when the count reaches a threshold number. In some embodiments, when the count reaches the threshold number, the controller 120 prevents further use of the device 100 until a replacement card 130 is installed in the device 100, such as the storage area 132.

Figure 12:
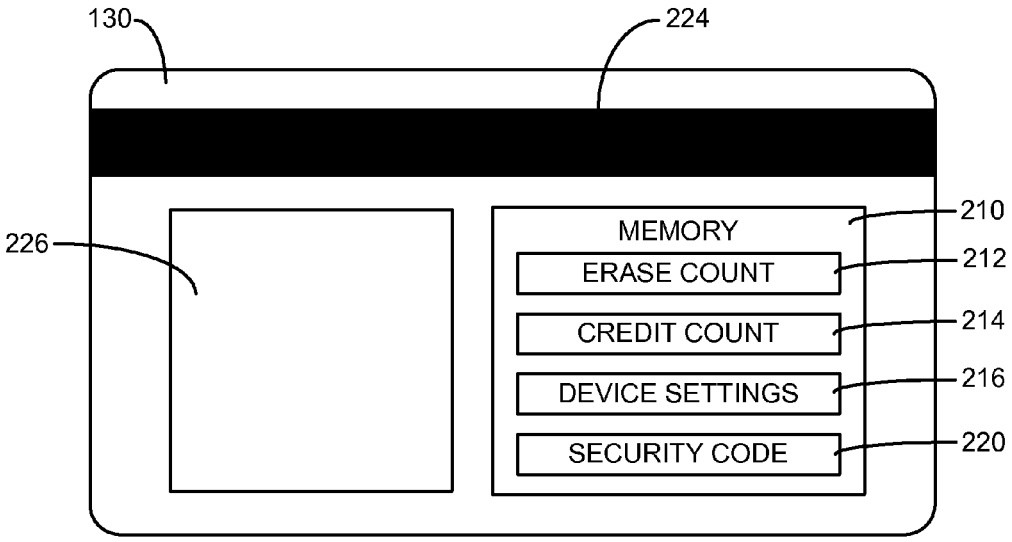
FIGS. 12 and 13 are simplified top views of a reusable card in accordance with embodiments of the invention.

In some embodiments, the reusable card 130 includes memory 210, as shown in the simplified top view of the reusable card 130 provided in FIG. 12, and the one or more operative units 102 of the device 100 include a conventional data reader/writer configured to read data from and/or write data to the memory 210. In some embodiments, the controller 120 stores an erase count 212 of the number of times the card 130 is used to erase or obscure a residual image in the memory 210. In some embodiments, the controller 120 accesses the count 212 from the memory 210 and compares the count 212 to a threshold count to determine whether the card 130 requires replacement. Accordingly, in some embodiments of the method of FIG. 2 described above, step 144 involves delivering the card 130 to the data reader/writer operative unit 102 and the controller accesses the memory 210 of the card 130. The erase count 212 stored in the memory 210 is read by the controller and compared to a threshold count. If the erase count 212 stored in the memory 210 exceeds the threshold count, the controller 120 notifies the user of the need to replace the card 130, or interrupts operation of the device 100. After the completion of a residual image erasure or obscurement process using the card 130, the controller 120 updates the erase count 212 stored in the memory 210 using the data reader/writer operative unit 102.

In some embodiments, the data reader/writer operative unit 102 of the device 100 is located proximate to the storage area 132. In some embodiments, the data reader/writer is configured to read data from and/or write data to the memory 210 of the reusable card 130 while the reusable card 130 is in the dedicated storage area 132. In some embodiments, the reusable card 130 must be fed by the at least one transport mechanism 112 from the storage area 132 to reach the data reader/writer for the memory 210 of the card 130 to be accessed by the controller 120 through the data reader/writer.

In some embodiments, the memory 210 of the reusable card 130 includes a credit count 214 (FIG. 12), which controls the use of the device 100 to process the substrates 108. In some embodiments, the credit count 214 is a count of the number of operative substrates 108 that may be processed using the device 100. In some embodiments of step 144 (FIG. 2), the controller 120 accesses the credit count 214 from the memory 210 using the operative unit 102 in the form of a conventional data reader/writer. In some embodiments, if the credit count 214 is greater than the number of substrates 108 to be processed, the controller 120 authorizes the processing of the substrates 108 using the device 100 and decrements the credit count 214 using the data reader/writer operative unit 102 accordingly.

In some embodiments, the credit count 214 corresponds to a period of time that the device 100 may be used to process the operative substrates 108, such as a number of hours, or an expiration date. In some embodiments of step 144 (FIG. 2), the controller 120 uses the data reader/writer to check that the period of time indicated by the credit count 214 stored in the memory 210 of the reusable card 130 has not expired before authorizing use of the device 100 to process one of the substrates 108. In some embodiments, if the period of time has not expired, the controller 120 authorizes the processing of the substrates 108 using the device 100, and decrements the credit count 214 (if applicable) using the data reader/writer operative unit 102.

In some embodiments, the controller 120 notifies the user of the device 100 when the credit count 214 drops below a threshold value or has expired. In some embodiments, the device 100 becomes inoperative until the credit count 214 stored in the memory 210 of the card 130 is renewed, or a new card 130 is installed in the storage area 132 of the device 100 having a valid credit count 214.

In some embodiments, the reusable card 130 is in the form of a configuration card. In some embodiments, the configuration card 130 includes device settings 216 stored in the memory 210. In some embodiments of step 144 (FIG. 2), the controller 120 accesses the device settings 216 using a data reader/writer operative unit 102, and modifies the settings 218 of the device 100 stored, for example, in the memory 122 (FIG. 1) based on the device settings 216. Thus, different settings for the device 100 may be easily programmed through the installation of the appropriate card 130. This allows the device 100 to be delivered to customers in a generic configuration, which may be modified simply by providing the card 130 with the desired device settings 216. Exemplary device settings 216 include: a kiosk mode, in which the substrates 108 are retrieved from the output of the device 100 rather than from the substrate supply 106; print settings including an image darkness setting to adjust the intensity of heat used during a printing operation; a top of form (TOF) setting that adjusts the physical position of the substrates 108 relative to the print head 154 at which a printing operation commences to adjust the position of the image printed to the substrate relative to the leading edge of the substrate 108; network communication settings to set, for example, a default IP address, subnet and gateway settings; and other settings that affect the operation of the device 100.

In some embodiments, the device settings 216 include a custom color profile. In some embodiments of the method step 144, the custom color profile is loaded for use by the device 100, such as by adjusting the settings 218 based on the custom color profile.

In some embodiments, the reusable card 130 includes a security code 220 stored in the memory 210, which is configured to restrict usage of the device 100. In some embodiments of the method step 144 (FIG. 1), when a user of the device 100 attempts to perform a secured process on one of the substrates 108 with the device 100, such as a printing or data writing process, the controller 120 accesses the security code 220 using the operative unit 102 in the form of a data reader/writer. The controller 102, or other application, performs a security check using the security code 220 to determine whether the secured process should be performed by the device 100. If the security code 220 enables the secured process, the device 100 performs the secured process on one or more of the substrates 108. If the security code 220 does not enable the secured process, the device 100 does not perform the secured process on one or more of the substrates 108.

In some embodiments, the reusable card 130 is in the form of a calibration card. In some embodiments of the method step 144, the controller 120 uses the reusable card 130 to perform a calibration routine on the device 100. In some embodiments, settings 218 of the device 100 stored, for example, in the memory 122, are adjusted based on the calibration routine performed using the reusable card 130.

In some embodiments, the operative unit 102 is in the form of a conventional card sensor, such as an optical sensor, and the calibration routine performed using the reusable card 130 includes a calibration of the card sensor. For instance, a user selects or enters substrate information corresponding to the operative substrates 108 that are installed in the device 100. In some embodiments, the calibration routine performed using the reusable card 130 operates to calibrate the card sensor to detect the installed operative substrates 108.

Figure 13:
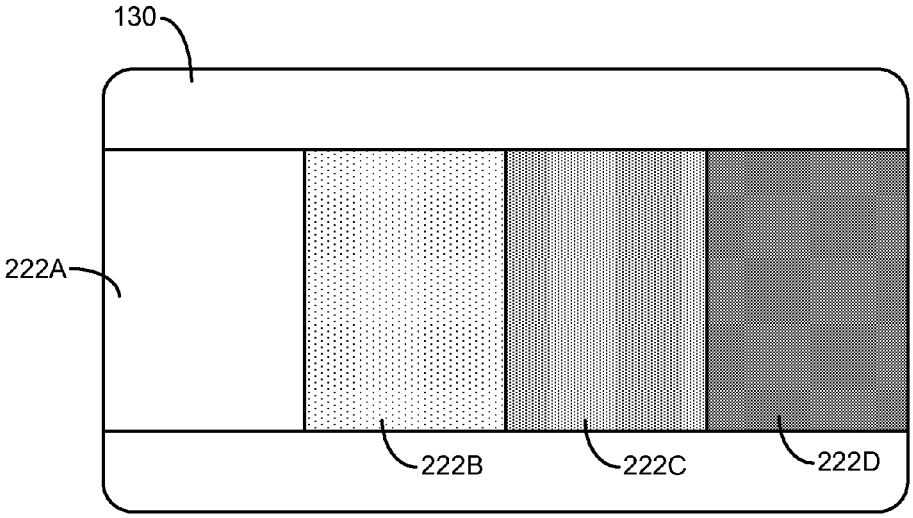

In some embodiments, a transparency level of the substrates 108 is obtained from the substrate information. In some embodiments, the reusable card 130 comprises multiple portions 222, such as portions 222A-D shown in FIG. 13, each having a different level of transparency corresponding to a transparency level of available operative substrates 108. In some embodiments of step 142 of the method, the reusable card 130 is fed from the storage area 132 to the card sensor operative unit 102 such that the portion 222 of the card 130 corresponding to the transparency level identified by the substrate information is positioned for sensing by the card sensor 102.

In some embodiments of step 144 of the method, the controller 120 performs a calibration routine for the card sensor 102 such that the card sensor operative unit 102 is properly set to detect the transparency level of the installed substrates 108. This may involve, for example, gradually increasing an intensity of a light source of the card sensor until the light is detected by a light sensor on the opposite side of the portion 222 of the card 130. The calibration routine is completed when the light sensor detects a threshold intensity level of the light transmitted through the portion 222 of the card 130. The reusable card 130 is then returned back to the storage area 132, as indicated at step 146.

In accordance with another embodiment, the reusable card 130 is used to perform a magnetic calibration. In accordance with this embodiment, the one or more operative units 102 include a magnetic encoder, such as those configured to write data to, and/or read data from, a magnetic stripe of a card substrate. In some embodiments, the reusable card 130 includes a magnetic stripe or other magnetic feature 224 (FIG. 12) that is used to configure the magnetic encoder 102 of the device 100 during the method step 144 (FIG. 2). In some embodiments, the reusable card 130 is fed from the storage area 132 to the magnetic encoding system 102 (step 142) and a calibration routine is performed on the magnetic encoder 102 using the reusable card 130. In some embodiments, this calibration routine comprises writing magnetic information to, and/or reading magnetic information from, the magnetic feature 224 of the card 130, using the magnetic encoder 102. In some embodiments, settings for the magnetic encoder 102 are adjusted in response to the writing and/or reading processes to complete the calibration routine. Following the calibration routine, the reusable card 130 may be returned to the storage area 132 (step 146).

In some embodiments, the reusable card 130 is in the form of a color calibration card. Here, the one or more operative units 102 include a color scanner, such as a linear sensor array, that is configured to verify the color of images printed to the operative substrates 108. In some embodiments, the reusable card 130 includes a color calibration image 226 (FIG. 12) having known color densities. In some embodiments of the method of FIG. 2, the reusable card 130 is delivered from the storage area 132 to the color scanner 102, at step 142. In some embodiments of step 144, the color calibration image 226 is scanned using the color scanner 102, and the scan is used to calibrate the color scanner 102. In some embodiments, the reusable card 130 is returned to the storage area 132, at step 146.

After a period of use, such as after processing 150-200 of the substrates 108, it may be desirable to perform one or more cleaning operations to ensure proper operation of the device 100. In some embodiments, the card 130 is in the form of a cleaning card that includes a sticky or tacky surface that allows the card 130 to collect debris stuck to surfaces of the card path along which the substrates 108 are fed by the one or more transport mechanisms 112, such as rollers 114 (FIG. 1) or other surfaces of the device 100. In some embodiments, step 144 of the method of FIG. 2 involves feeding the card 130 along the card path using the at least one transport mechanism 112, and collecting debris from surfaces of the card path onto the card 130. The card 130 is then returned to the storage area 132, at step 146, to complete the card path cleaning operation.

In some embodiments, the card 130 is configured to be used in a cleaning operation on the print head 154. Embodiments of the print head 154 include the thermal print head described above, and an inkjet print head, which sprays dots of ink and does not use the print ribbon 152. In some embodiments of the method of FIG. 2, the card 130 is fed from the storage area 132 to the print head 154 (step 142), and a cleaning process on the print head 154 using the card 130 (step 144). In some embodiments, the card 130 is returned to the storage area 132 following the cleaning operation.

Figure 14:
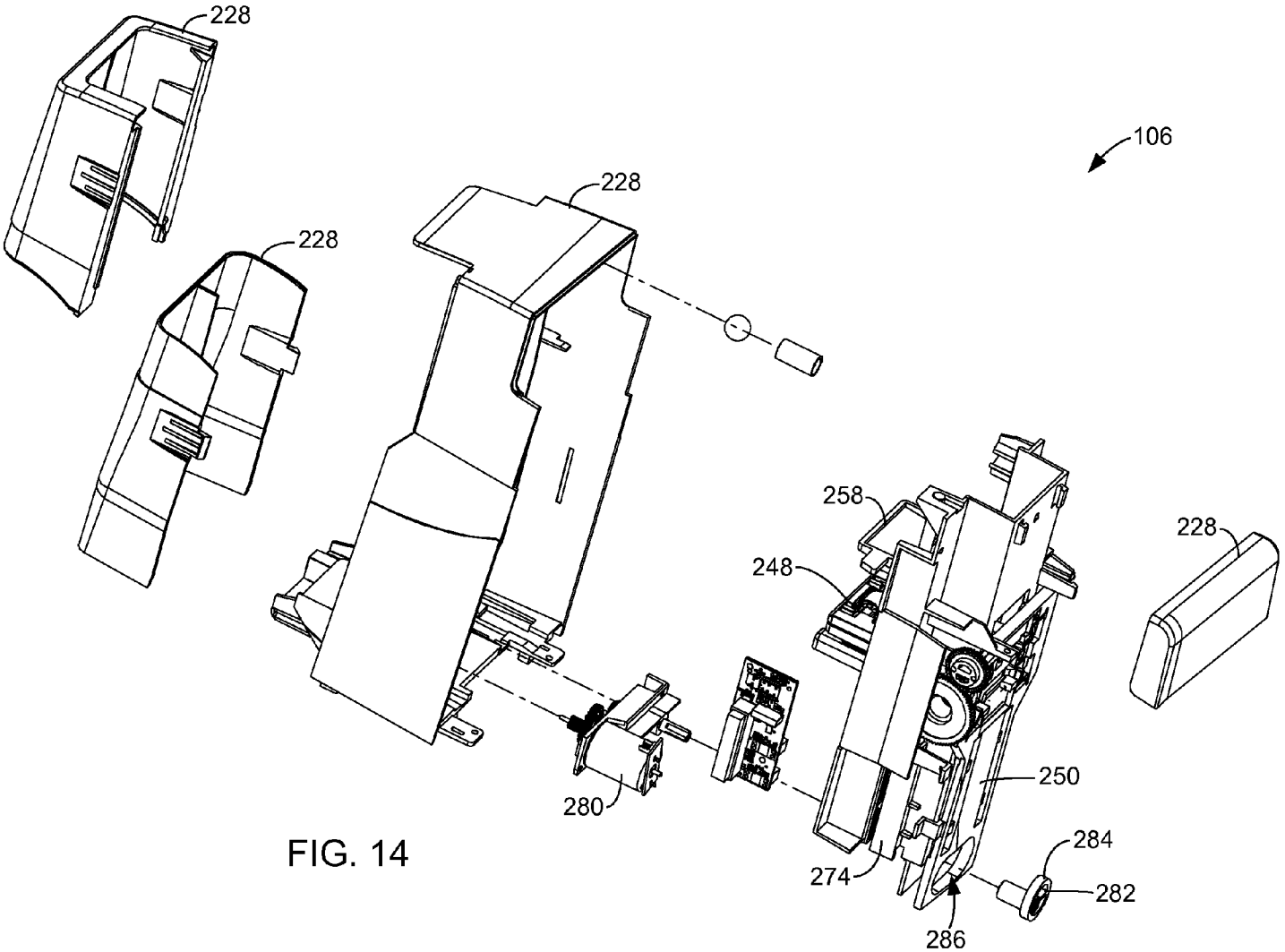
FIG. 14 is an exploded isometric view of a substrate supply in accordance with embodiments of the invention.
Figure 15:
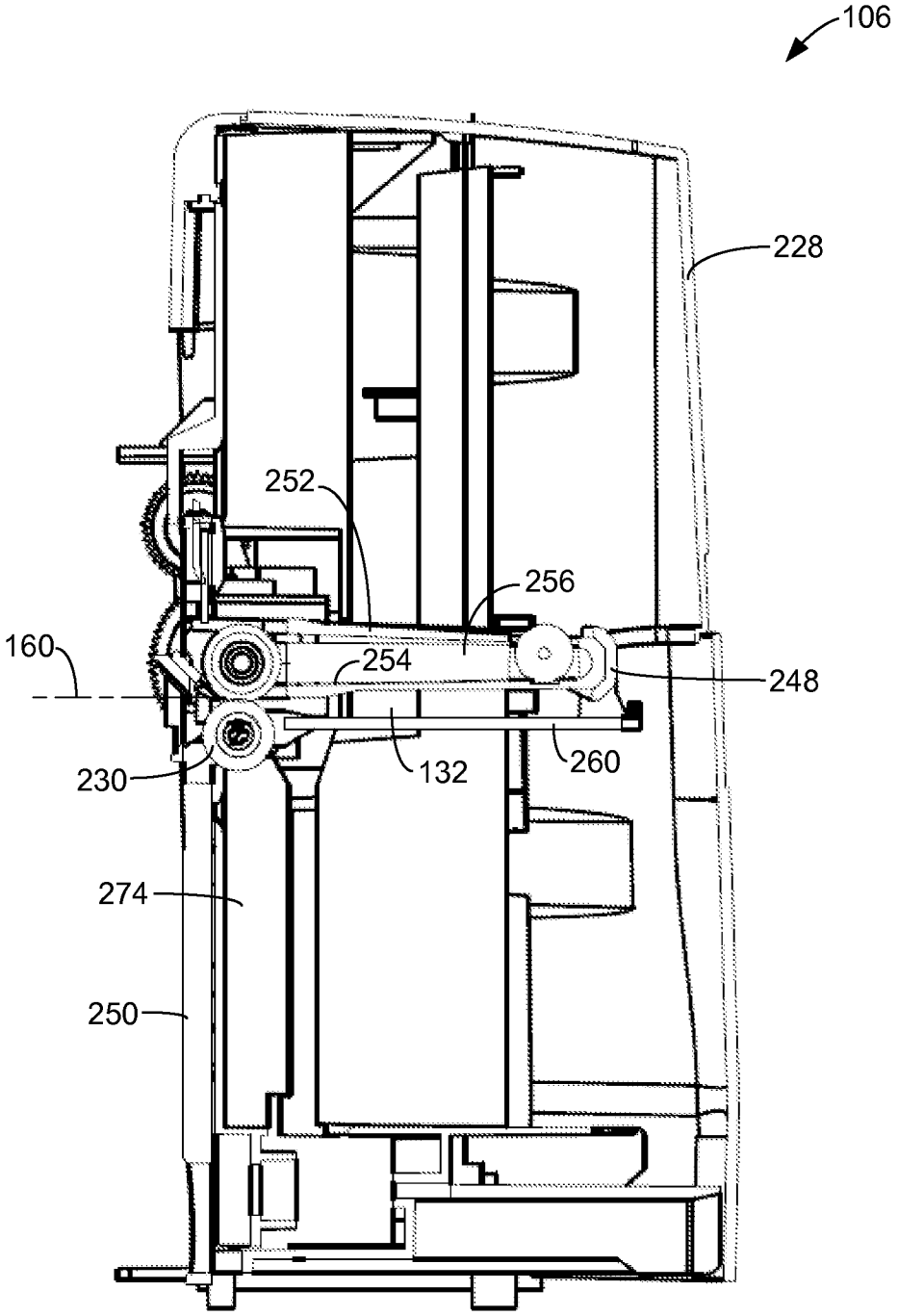
FIG. 15 is a side view of the substrate supply of FIG. 14 with a portion of a housing removed.
Figure 16:
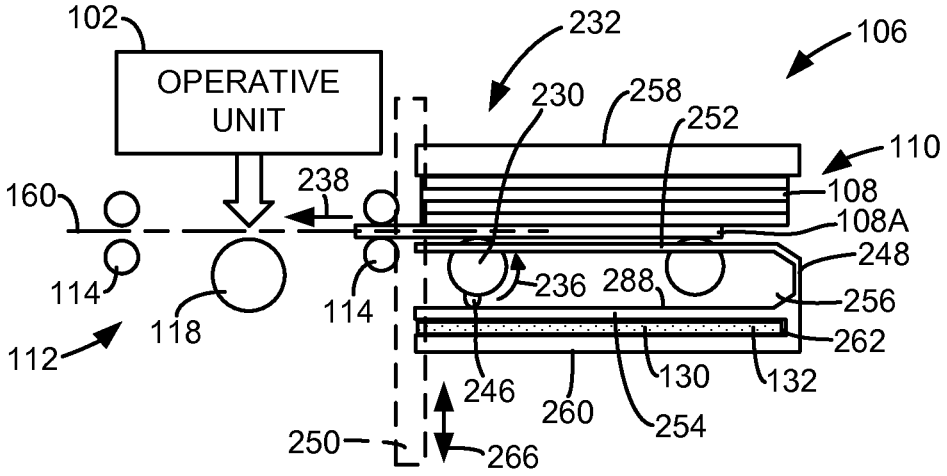
FIGS. 16 and 17 respectively are simplified side and front views of portions of a substrate supply in a first position, in accordance with embodiments of the invention.
Figure 17:
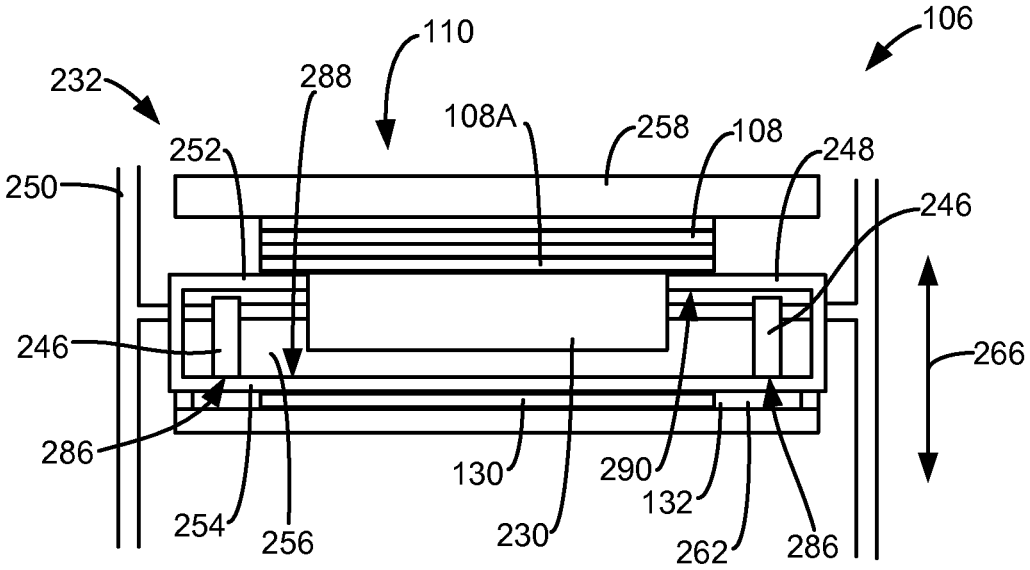
Figure 18:
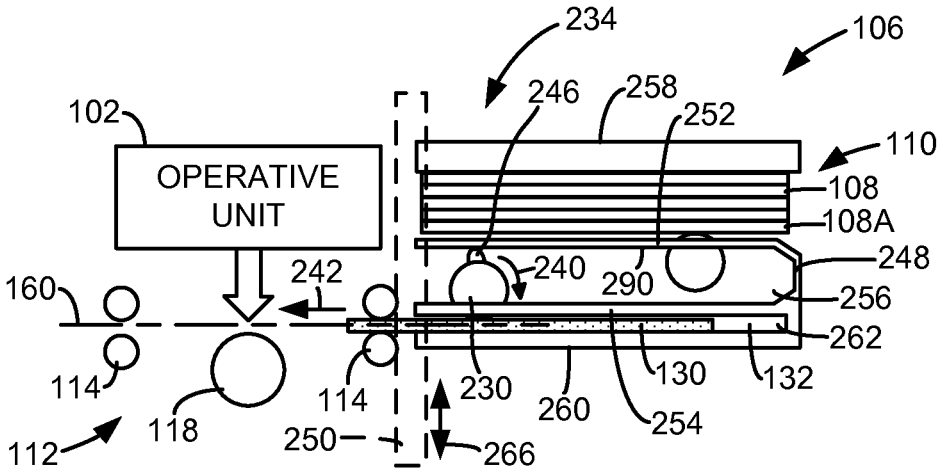
FIGS. 18 and 19 respectively are simplified side and front views of portions of a substrate supply in a second position, in accordance with embodiments of the invention.
Figure 19:
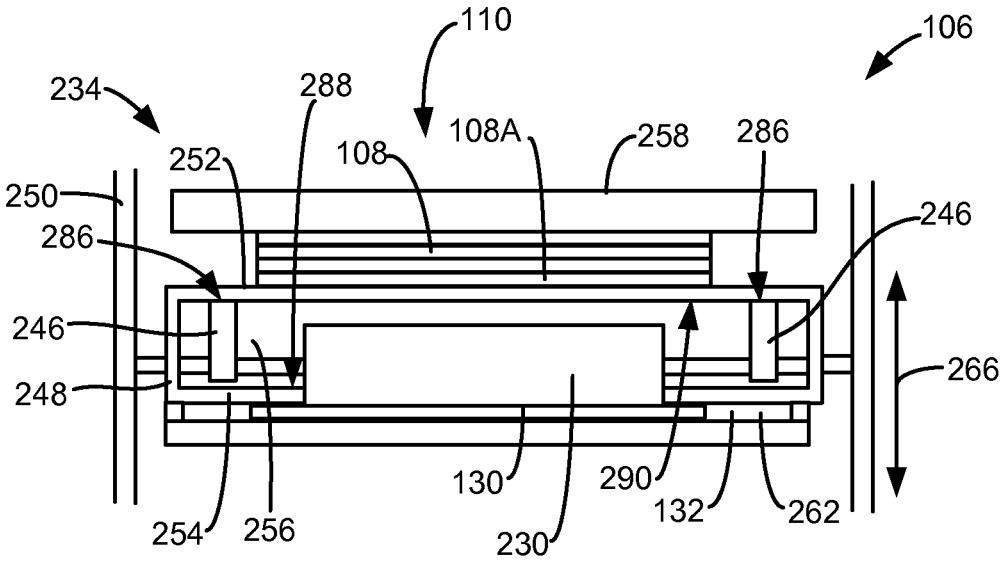

As mentioned above, in some embodiments, the card 130 is stored within the substrate supply 106 along with at least one bin (e.g., bin 110) of operative substrates 108, as shown in FIG. 1. Some exemplary embodiments of the substrate supply 106 will be described with reference to FIGS. 14-19. FIG. 14 is an exploded isometric view of the substrate supply 106 in accordance with embodiments of the invention. FIG. 15 is a side view of the substrate supply 106 of FIG. 14 with a portion of the housing removed. FIGS. 16 and 17 respectively are simplified side and front views of portions of the substrate supply 106 in a first position, in accordance with embodiments of the invention. FIGS. 18 and 19 respectively are simplified side and front views of portions of the substrate supply 106 in a second position, in accordance with embodiments of the invention. In some embodiments, the substrate supply 106 is configured to operate similarly to that described in International Application No. PCT/US2012/029164, which is incorporated herein by reference in its entirety.

In some embodiments, the substrate supply 106 includes exterior housing components 228 covering the upper bin 110 and the storage area 132, as shown in FIG. 15. In some embodiments, the substrate supply 106 is configured to feed operative substrates 108 from the upper bin 110, and the reusable card 130 from the storage area 132 along a processing path 160. It is understood that the exemplary substrate supply 106 of FIGS. 14-19 may be adjusted to place the storage area 132 above a lower bin 111 (FIG. 1) of the operative substrates 108.

In some embodiments, the feeding of the substrates 108 and the reusable card 130 is achieved using an input feed roller or pinch roller pair 230 (hereinafter "input feed roller") of the at least one transport mechanism 112 positioned between the upper bin 110 and the storage area 132. In some embodiments, the input feed roller 230 is movable relative to the processing path 160 to selectively feed a bottom card 108A from the upper bin 110, or the reusable card 130 from the storage area 132, for feeding along the processing path 160 using the at least one transport mechanism 112, such as feed rollers 114 (FIG. 1).

In some embodiments, the substrate supply 106 has a first position 232, in which it feeds the bottom card 108A from the upper bin 110 along the processing path 160, as illustrated in FIGS. 16 and 17. In some embodiments, the substrate supply 106 has a second position 234, in which it feeds the reusable card 130 from the storage area 132 along the processing path 160, as illustrated in FIGS. 18 and 19.

In some embodiments, the input feed roller 230 is placed in contact with the bottom substrate 108A in the bin 110, and the input feed roller 230 is displaced from the reusable card 130 supported in the storage area 132, when in the first position 232, as shown in FIGS. 16 and 17. When in the first position 232, the input feed roller 230 is motor driven in the direction indicated by arrow 236 to drive the bottom card 108A for feeding along the processing path 160, as indicated by arrow 238.

In some embodiments, the input feed roller 230 is placed in contact with the reusable card 130 supported in the storage area 132, and is displaced from the bottom card 108A when in the second position 234, as shown in FIGS. 18 and 19. When in the second position 234, the input feed roller 230 is motor driven in the direction indicated by arrow 240 to drive the reusable card 130 along the processing path 160, as indicated by arrow 242 and shown in FIG. 18.

In some embodiments, the substrate supply 106 includes the input feed roller 230, one or more cams 246, a substrate engaging table 248 and a sliding bracket 250, as best shown in FIGS. 17 and 19. In some embodiments, the input feed roller 230, the one or more cams 246 and the substrate engaging table 248 are attached to, or are supported by the sliding bracket 250. In some embodiments, the table 248 comprises a top table member 252 and a bottom table member 254 that are separated by a gap 256, as shown in FIGS. 16 and 18. In some embodiments, the cams 246, which are displaced from the input feed roller 230 (FIGS. 16 and 18) are configured to rotate or pivot about the axis of the input feed roller 230 independent of the rotation of the input feed roller 230. In some embodiments, the cams 246 may rotate or pivot about an axis supported by the bracket 250 that is different from the axis of rotation of the roller 230.

In some embodiments, the upper bin 110 of the substrate supply includes a biasing mechanism 258 that applies a bias force to a stack of substrates 108 supported in the upper bin 110 that directs the stack of substrates 108 toward the top table member 252 and the input feed roller 230. Exemplary embodiments of the biasing mechanism 258 include a spring, a weight (shown) or other suitable biasing mechanisms.

In some embodiments, the storage area 132 is defined by the bottom table member 254 and a support 260 attached to the table 248 or the sliding bracket 250. Accordingly, the storage area 132 moves with movement of the table 248 and/or the sliding bracket 250. In some embodiments, a gap 262 formed between the members 254 and 260 accommodates a single reusable card 130, as shown in FIG. 16

In some embodiments, the sliding bracket 250 is movable in a vertical direction as illustrated by arrow 266 in FIGS. 16-19. In some embodiments, the input feed roller 230 and the table 248 also move along the direction 266 relative to the processing path 160. In some embodiments, this movement of the input feed roller 230 and the table 248 is responsive to movement of the sliding bracket 250. In some embodiments, the substrate engaging table 248 also moves relative to the input feed roller 230 along the direction 266, in response to movement of the sliding bracket 250.

In some embodiments, the substrate supply 106 includes a main bracket 274 that supports the sliding bracket 250. In some embodiments, the sliding bracket 250 includes components that cooperate with components of the main bracket 274 to allow the sliding bracket 250 to slide in the direction of arrow 266 relative to the main bracket 274. In some embodiments, the substrate supply 106 includes a motor 280 and a cam 282, as shown in FIG. 14. The cam 282 includes a cam surface 284 that engages an interior wall of an opening 286 of the sliding bracket 250. The motor 280 drives rotation of the cam 282 and the cam surface 284 directs the sliding bracket 250 either upward or downward in the direction 266 relative to the main bracket 274, to move the sliding bracket 250 between its first position 232 and the second position 234.

In some embodiments, the substrate supply 106 is set to the first position 232 by lowering the sliding bracket 250, the input feed roller 230, and the table 248 relative to the processing path 160 along the direction 266. In some embodiments, the input feed roller 230 is lowered to a position that places a majority of the roller 230 below the processing path 160, as shown in FIG. 16. In some embodiments, the lowering of the sliding bracket 250 causes the cams 246 to rotate about an axis, such as the axis of rotation of the input feed roller 230, and direct a surface 286 of the cams 246 to push against a lower inner surface 288 of the bottom table member 254 of the table 248. The force applied to the surface 288 by the cams 246 pushes the bottom table member 254 downward in the direction 266 relative to the input feed roller 230. In some embodiments, the storage area 132 with the card 130 moves downward with the bottom table member 254 in response to the movement of the sliding bracket 250, displacing the reusable card 130 from the input feed roller 230. Additionally, the top table member 252 is lowered relative to the input feed roller 230 responsive to the lowering of the table 248 by the cams 246. This causes the input feed roller 230 to engage the bottom substrate 108A of the upper bin 110 through, for example, an opening in the top table member 252. The rotation of the input feed roller 230 in the direction 236 drives the bottom substrate 108A from the substrate supply 106 where it can be received by components of the at least one transport mechanism 112, such as feed rollers 114, for feeding along the processing path 160 to, for example, the one or more operative units 102 for processing. The substrate supply 106 may remain in the first position 232 to feed additional substrates 108 from the bin 110 for processing. In some embodiments, the processed substrates 108 are discharged from the device 100 through a suitable output port.

In some embodiments, the transition of the substrate supply 106 from the first position 232 to the second position 234 involves raising the sliding bracket 250, the input feed roller 230, and the substrate engaging table 248 in the direction 166 relative to the processing path 160, as shown in FIGS. 18 and 19. In some embodiments, the input feed roller 230 is raised to a position that places a majority of the roller 230 above the processing path 160. Additionally, the table 248 is raised relative to the input feed roller 230 through the rotation of the cams 246 about the axis of rotation of the input feed roller 230. In some embodiments, the raising of the sliding bracket 250 causes the cams 246 to rotate or pivot about an axis, such as the axis of the input feed roller 230, and the surface 286 to push against an upper inner surface 290 of the table member 252 to push the table 248, or at least the table member 252, upward in the direction 266 relative to the input feed roller 230. This upward movement of the table member 252 pushes the stack of operative substrates 108 upward and displaces the bottom substrate 108A from the input feed roller 230, as shown in FIGS. 18 and 19.

Additionally, the bottom table member 254 and the support 260 of the storage area 132 are raised relative to the input feed roller 230 responsive to the raising of the table 248 by the cams 246. This causes the input feed roller 230 to engage the reusable substrate 130 in the storage area 132 through, for example, an opening in the bottom table member 254. The rotation of the input feed roller 230 in the direction 240 drives the reusable card 130 out of the substrate supply for feeding along the processing path 160 using the at least one transport mechanism 112, such as feed rollers 114, to complete the method step 142 (FIG. 2), as shown in FIG. 18.

The substrate supply 106 may remain in the second position 234 to await the return of the reusable card 130 for feeding back into the storage area 132 to complete step 146 of the method of FIG. 1. In some embodiments, the reusable card 130 is returned to the storage area 132 by feeding the reusable card 130 along the processing path 160 toward the substrate supply 106. The feed roller 230 is then rotated in the opposite direction from that indicated by arrow 240 (FIG. 18) to drive the reusable card 130 into the storage area 132 and complete step 146 of the method of FIG. 2. The substrate supply 106 may then be returned to the first position 232 to allow the device 100 to process one or more of the operative substrates 108.

Although the present invention has been described with reference to preferred embodiments, workers skilled in the art will recognize that changes may be made in form and detail without departing from the spirit and scope of the invention.

What is claimed is:

1. A printing device comprising:

a substrate supply configured to support a plurality of print substrates;

a reusable card stored in a dedicated storage area, which does not receive the print substrates;

an operative unit;

at least one transport mechanism; and a controller configured to control the at least one transport mechanism and the operative unit to deliver the reusable card from the storage area to the operative unit, to process the reusable card with the operative unit, and return the reusable card to the storage area, multiple times.

2. The device of claim 1, wherein the device includes a housing and the storage area is internal to the housing.

3. The device of claim 1, further comprising a substrate hopper containing the substrate supply and the storage area.

4. The device of claim 1, wherein the reusable card is selected from the group consisting of a cleaning card, a security card, and a calibration card.

5. The device of claim 1, further comprising a print ribbon and wherein:

the reusable card comprises an erase card;

the operative unit comprises a print head; and the controller is configured to process the reusable card using the operative unit including obscuring a residual image, which was previously formed on a print ribbon responsive to printing an image to a substrate, by printing an image to the erase card using the print head and a portion of the print ribbon comprising the residual image.

6. The device of claim 5, wherein:

the device includes a memory, and a usage count stored in the memory indicating an amount of usage of the reusable card; and the controller is configured to update the usage count in response to usage of the reusable card.

7. The device of claim 5, wherein the memory is attached to the reusable card.

8. A method of operating a printing device comprising:

storing a reusable card in a storage area of the printing device;

performing at least one process using the reusable card comprising:

feeding the reusable card from the storage area using at least one transport mechanism of the printing device;

performing the at least one process using the reusable card; and returning the reusable card to the storage area using the at least one transport mechanism.

9. The method of claim 8, wherein performing the at least one process using the reusable card comprises performing a process using the reusable card selected from the group consisting of obscuring at least one residual image on a print ribbon of the device; cleaning a component of the printing device; reading data from the reusable card using a data reader of the printing device; writing data to the reusable card using a data writer of the printing device; calibrating a component of the printing device; and performing a security check.

10. The method of claim 8, wherein performing at least one process on the reusable card occurs:

before or at the end of a print operation performed by the printing device;

before or at the end of a print session comprising multiple print operations performed by the printing device;

when an end of the print ribbon has been reached or when a print ribbon change is requested;

in response to starting the printing device, rebooting the printing device, or shutting-down the printing device; or in response to a request from a user or an external controller.

11. The method of claim 8, further comprising tracking an amount of usage of the reusable card in memory of the printing device or the reusable card using a controller of the printing device.

12. The method of claim 11, wherein the controller is configured to trigger an alert when the amount of usage of the reusable card exceeds a predetermined value.

13. The method of claim 8, wherein the storage area is internal to a housing of the printing device.

14. The method of claim 8, wherein:

the printing device includes a print ribbon and a print head;

the method includes performing a print operation comprising:

feeding a substrate from a substrate supply, which is separate from the storage area, using the at least one transport mechanism; and printing a first image on the substrate using a portion of the print ribbon and the print head;

wherein the portion of the print ribbon includes a residual image corresponding to the printed first image; and performing the at least one process using the reusable card comprises obscuring the residual image including printing a second image to the erase card using the print head and the portion of the print ribbon comprising the residual image.

15. The method of claim 14, wherein performing the at least one process using the reusable card comprises performing a process using the reusable card selected from the group consisting of cleaning a component of the printing device; reading data from the reusable card using a data reader of the printing device; writing data to the reusable card using a data writer of the printing device; calibrating a component of the printing device; and performing a security check.

16. The method of claim 8, wherein:

the printing device includes a print ribbon and a print head;

the method includes performing a plurality of print operations comprising:

delivering a substrate from a substrate supply, which is separate from the storage area, using the at least one transport mechanism;

printing an image on the substrate using a portion of the print ribbon and the print head, wherein the portion of the print ribbon includes a residual image corresponding to the printed image; and repeating the delivering and printing steps a limited number of times; and performing the at least one process using the reusable card comprises obscuring the residual images on the print ribbon including printing at least one obscuring image to the reusable card using the print head and the print ribbon.

* * * * *